US008169456B2

(12) United States Patent
Seo

(10) Patent No.: US 8,169,456 B2
(45) Date of Patent: May 1, 2012

(54) PRINT HEAD AND IMAGE FORMING APPARATUS EMPLOYING THE SAME

(75) Inventor: Woon-ho Seo, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 336 days.

(21) Appl. No.: 12/431,006

(22) Filed: Apr. 28, 2009

(65) Prior Publication Data

US 2010/0013902 A1 Jan. 21, 2010

(30) Foreign Application Priority Data

Jul. 17, 2008 (KR) ..... 10-2008-0069741

(51) Int. Cl.
*B41J 2/45* (2006.01)

(52) U.S. Cl. ..... 347/238

(58) Field of Classification Search ..... 347/238, 347/244, 258; 359/204.5, 207.7, 217.4, 568, 359/558, 563, 569–575
See application file for complete search history.

(56) References Cited

U.S. PATENT DOCUMENTS

| | | | | |
|---|---|---|---|---|
| 5,073,041 | A * | 12/1991 | Rastani | 385/33 |
| 5,317,170 | A * | 5/1994 | Paoli | 257/88 |
| 5,337,074 | A * | 8/1994 | Thornton | 347/237 |
| 6,259,888 | B1 * | 7/2001 | Kazama et al. | 399/406 |
| 6,836,612 | B2 * | 12/2004 | Morris et al. | 385/147 |
| 6,888,871 | B1 * | 5/2005 | Zhang et al. | 372/75 |

* cited by examiner

*Primary Examiner* — Hai C Pham
(74) *Attorney, Agent, or Firm* — Staas & Halsey LLP

(57) ABSTRACT

Disclosed are a print head and an image forming apparatus employing the same. The print head, which irradiates light to multiple locations of a photosensitive medium to form pixels of electrostatic latent image, includes an array of light sources corresponding to the pixels, a distributed Bragg reflector disposed adjacent the surface of the light source array from which the light source array output light, and a light focusing unit which focuses the light that have passed through the distributed Bragg reflector onto the locations of photosensitive medium.

13 Claims, 3 Drawing Sheets

PRINT HEAD AND IMAGE FORMING APPARATUS EMPLOYING THE SAME

CROSS-REFERENCE TO RELATED PATENT APPLICATION

This application claims the benefit of Korean Patent Application No. 10-2008-0069741, filed on Jul. 17, 2008, in the Korean Intellectual Property Office, the disclosure of which is incorporated herein by reference in its entirety.

TECHNICAL FIELD

The present disclosure relates to a print head and an image forming apparatus employing the same.

BACKGROUND OF RELATED ART

A conventional electro-photographic image forming apparatus forms an electrostatic latent image by exposing a photosensitive medium to light by scanning a laser beam on the photosensitive medium, and forms a toner image by selectively supplying toner to the electrostatic latent image on the photosensitive medium from a developing roller that is either spaced apart from or in contact with the photosensitive medium.

Such a conventional electro-photographic image forming apparatus typically requires a laser scanning apparatus for scanning a laser beam on the photosensitive medium. The laser scanning apparatus requires highly accurate optical arrangement, and thus tends to be expensive. Accordingly, an apparatus that can replace the laser scanning apparatus is desirable. To that end, a print head is being developed to include a number of light emitting devices, such as light emitting diodes (LED), organic light emitting diodes (OLED), or inorganic electroluminescence (EL), in sufficient number as to correspond to a number of pixels for concurrent forming at least a portion of the electrostatic latent image on the photosensitive medium.

For example, shown in FIG. 1 is an illustration of an example conventional print head 19. The print head 19 includes light emitting points 18 arranged in a uniform pitch. The light emitting points 18 are formed on a transparent board 12, and include an opaque metal electrode 24 forming a cathode used as a common electrode, an organic light emitting layer 22 emitting a beam and a transparent electrode 20 forming an anode for addressing each light emitting point 18.

However, since a beam emitted from a light emitting device, such as an OLED or an inorganic EL, has a wide divergence angle, a crosstalk between two beams emitted from neighboring light emitting points 18 may occur, causing the image quality to suffer, e.g., due to an unintended pixel being irradiated. In an attempt to focus the beams emitted from each light source on the corresponding pixel of the photosensitive medium 10, a micro-lens array including convex lenses 16 each corresponding to the respective light emitting point 18 are provided. However, even when the beams are focused by using the convex lenses 16, a chromatic aberration may be generated because of the wide spectrum of wavelength associated with some of the light emitting devices, such as, e.g., an OLED or an organic EL, and it is difficult to form an accurate image on the photosensitive medium 10 with the small depth of focus.

Further, the non-planar nature of the micro-lens array of convex lenses 16 makes it difficult to fabricate the micro-lens array directly on the surface of the light emitting device, and thus may complicate the manufacturing process of the print head by requiring additional fabrication steps and/or elements, such as a spacer.

SUMMARY OF THE DISCLOSURE

According to an aspect of the present disclosure, a print head for irradiating light onto a plurality of locations of a photosensitive medium may comprise a light source array including light emitting points corresponding to each of the plurality of locations of the photosensitive medium, a distributed Bragg reflector disposed adjacent a light emitting surface of the light source array and a light focusing unit which focuses light that have passed through the distributed Bragg reflector onto the photosensitive medium.

The light focusing unit may comprise a micro lens array disposed on one side of the distributed Bragg reflector. Each micro lens of the micro lens array may be arranged to correspond to a respective one of the plurality of locations of the photosensitive medium.

The micro lens array may comprise an array of refractive lenses. The light focusing unit may further comprise a micro diffractive device array formed on one side of the micro lens array in a manner such that each micro diffractive device corresponds to a respective one of the refractive lens.

Both the side of the micro lens adjacent the distributed Bragg reflector and the side opposite thereto may comprise substantially planar surfaces.

Each micro lens of the micro lens array may comprise a gradient index lens.

Each micro lens of the micro lens array may comprise a first lens of a first refractive index having a first surface that is flat and a second surface that is concave and a second lens of a second refractive index different from the first refractive index having a third surface that is convex corresponding to concavity of the second surface and a fourth surface that is flat.

The first refractive index may be smaller than the second refractive index.

The distributed Bragg reflector may comprise an odd number of layers greater than or equal to three layers, each neighboring pair of layers being of materials of different refractive indexes with respect to each other.

Each of the light emitting points may be any one selected from the group consisting of an organic light emitting diode, an organic electroluminescence and an inorganic electroluminescence.

According to another aspect, an image forming apparatus may include a photosensitive medium configured to carry thereon a latent image, a print head configured to irradiates light to locations on the photosensitive medium corresponding to pixels of the latent image, a developing unit configured to supply developer to the photosensitive medium to form a visible image corresponding to the latent image, a transfer unit which transfers the visible image onto a printing medium and a fusing unit configured to fix the transferred visible image on the printing medium. The print head may comprise a light source array including light emitting points corresponding to each of the pixels, a distributed Bragg reflector disposed on a light emitting surface of the light source array and a light focusing unit configured to focus light from the light emitting points that have passed through the distributed Bragg reflector onto the photosensitive medium.

According to yet another aspect, A print head for forming an electrostatic latent image on a photosensitive medium may comprise a light source array including a plurality of light emitting sources, each of which corresponding to a respective one of pixels of the electrostatic latent image, and a light emitting surface from which light beams from the light emitting sources are output from the light source array, a reflector of a periodically varying index of refraction disposed adjacent the light emitting surface of the light source array to receive the light beams therefrom, and to output a portion of the light beams received from the light source array as reflected output beams, and a light focusing unit disposed adjacent the reflector, the light focusing unit comprising an array of lenses configured to focus the reflected output beams received from the reflector onto locations on the photosensitive medium corresponding to the pixels.

BRIEF DESCRIPTION OF THE DRAWINGS

Various aspects of the present disclosure will become apparent and more readily appreciated from the following description of the embodiments, taken in conjunction with the accompanying drawings, of which.

DETAILED DESCRIPTION OF SEVERAL EMBODIMENTS

Figure 1:
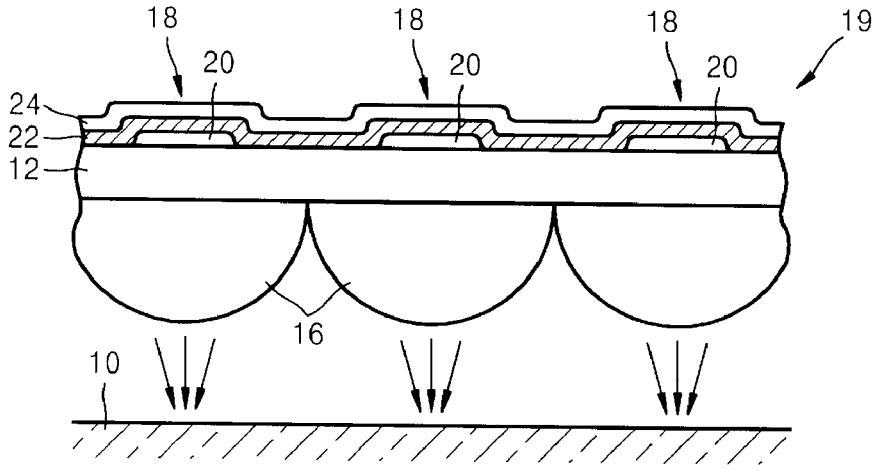
FIG. 1 (RELATED ART)
FIG. 1 illustrates an example of a conventional print head.

Reference will now be made in detail to embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

Figure 2:
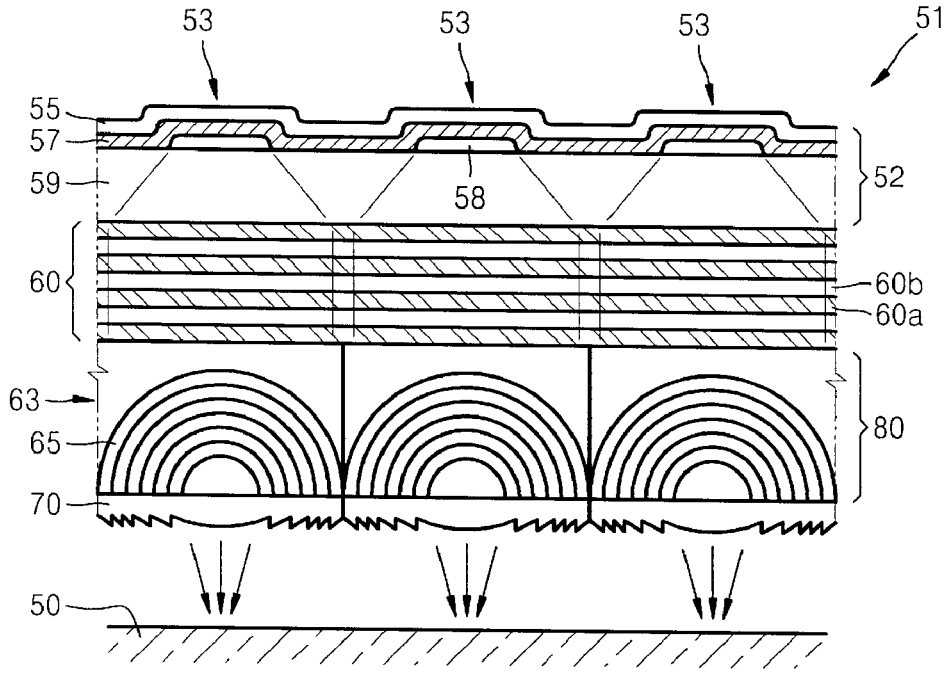
FIG. 2 illustrates a print head according to an embodiment of the present invention.

FIG. 2 illustrates a print head 51 according to an embodiment of the present disclosure, in which an electrostatic latent image is formed by irradiating light to selective pixel locations on the photosensitive medium 50. The print head 51 according to the embodiment may include a light source array 52 including light emitting points 53 arranged to corresponding to the respective pixel locations of the photosensitive medium 50, and a distributed Bragg reflector 60 disposed on the light emitting surface of the light source array 52.

The light emitting points 53 may be an organic light emitting diode (OLED), an organic electroluminescence (EL), an inorganic EL, or the like. When, for example, as shown in FIG. 2, the light emitting point 53 is an OLED, transparent electrodes 58, an organic light emitting layer 57, and an opaque metal electrode 55 may be disposed on a transparent board 59. According to an embodiment, the transparent electrodes 58 may operate as anodes for addressing each of the light emitting points 53 while the opaque metal electrode 55 may operate as the cathode used as a common electrode. When a voltage is applied to a light emitting point 53, a beam of light is emitted from the organic light emitting layer 57.

The distributed Bragg reflector 60 includes first layers **60*a* and second layers 60*b*, which are formed of materials having different refractive indices, and which are stacked in an alternating manner. The first and second layers 60*a* and 60*b* each has an optical thickness that approximate ¼ of the wavelength of the emitted beam. For example, the distributed Bragg reflector 60 may include an alternate stack of a $SiO_2$ layer and a $TiO_2$ layer with an odd number greater than three of total layers. When the distributed Bragg reflector 60 includes an odd number of layers according to an embodiment, the top and bottom layers may preferably be formed of a material that can operate as an electrode layer. While the distributed Bragg reflector 60** in the above embodiment is described as being formed by multiple layers of alternating materials with different refractive index, it will be apparent to those skilled in the art that other arrangements are possible for forming the distributed Bragg reflector, such as, for example, by providing periodic variation in dimension (such as, e.g., the height) of a dielectric material or materials.

Figure 3:
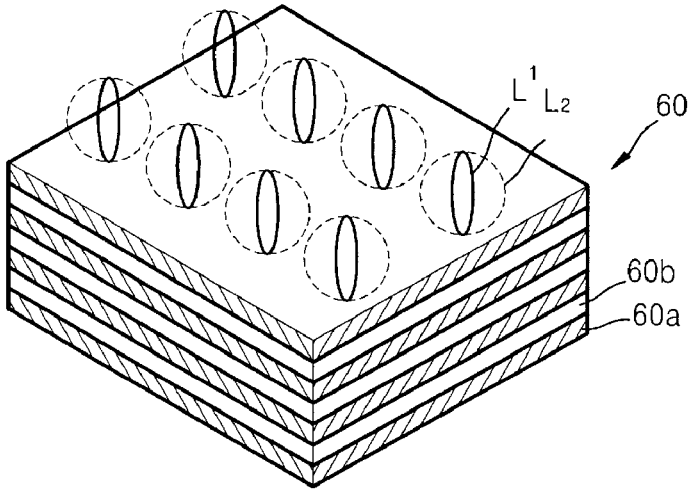
FIG. 3 illustrates divergences of beams propagating through a distributed Bragg reflector included in a print head according to an embodiment.

The distributed Bragg reflector 60 exhibits high wavelength selectivity, making it possible to output a beam of the desired wavelength. In addition, due to the destructive interference resulting for a beam with a high divergence angle, only beams of low divergence angle propagate through the distributed Bragg reflector 60. For example, FIG. 3 shows a first beam L1 that pass through the distributed Bragg reflector 60 and a second beam L2 that does not pass through the distributed Bragg reflector 60. The first beam L1 that passes through the distributed Bragg reflector 60 has a lower divergence angle than the second beam L2. According to a Bragg condition of the distributed Bragg reflector 60, only those beams that proceeds substantially perpendicular to the distributed Bragg reflector 60 propagate through the distributed Bragg reflector 60, and are output from the outside the distributed Bragg reflector 60. Accordingly, by the use of the distributed Bragg reflector 60, the a divergence angle of the light beams can be reduced, and in turn the potential for an optical crosstalk between beams from adjacent light emitting points 53 on the photosensitive medium 50 may be reduced. Each of the strengthening of the wavelength selectivity and the reduction in divergence may reduce the spectral width of the output beam of the distributed Bragg reflector 60, and thus can improve the quality of the resulting image.

According to an embodiment, a light focusing unit 80 for focusing the light that had propagated through the distributed Bragg reflector 60 on the photosensitive medium 50 may also be provided on one side of the distributed Bragg reflector 60. The outer surfaces of the distributed Bragg reflector 60 can be made substantially flat surfaces, which allows convenient interface between the distributed Bragg reflector 60 and the light source array 52, which itself has a substantially flat surface. The interface surface of the light focusing unit 80 may also be substantially flat so as to be conveniently interface with the distributed Bragg reflector 60. According to an embodiment, the light focusing unit 80 may include a refractive-diffractive micro lens array, which may further improve the image quality by removing chromatic aberration of the light from the light emitting points 53 and/or by increasing the depth of focus. According to one embodiment, the refractive-diffractive micro lens array may be an array of hybrid micro lenses wherein a refractive lens and a diffractive lens are integrated in one body. Referring to FIG. 2, the light focusing unit 80 includes a micro lens array 63, in which micro lenses 65 are arranged to each correspond to a respective pixel of the photosensitive medium 50, and a micro diffractive device array 70. In the micro diffractive device array 70, micro diffractive devices are arranged to also correspond to each pixel, and may be arranged in an one-to-one corresponding relationship with the micro lenses 65. The interfacing surfaces of each of the micro lenses 65 and the micro diffractive device array 70 may also be made flat so as to provide a convenient coupling therebetween.

The micro lens 65 may include, for example, a gradient index lens. A gradient index lens is manufactured to gradually change the refractive index by a silver ion exchange on a flat glass, and may achieve the same functional result as a convex lens. Since both sides of the gradient index lens may be made flat, the gradient index lens can provide convenient coupling to the distributed Bragg reflector 60. A micro diffractive device may be achieved by, for example, forming a grid pattern on a silicon board by using a focused ion beam (FIB).

Figure 4:
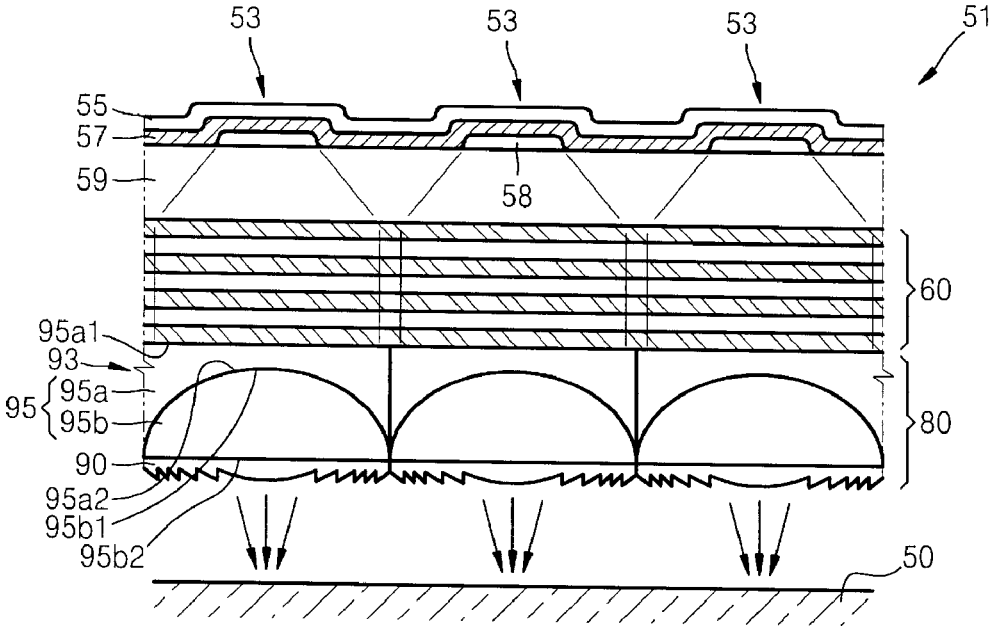
FIG. 4 illustrates a print head according to another embodiment.

FIG. 4 illustrates another example of the light focusing unit 80, which may includes a micro lens array 93 including micro lenses 95 and a micro diffractive device array 90. The micro lens 95 may include a first lens 95*a* having a first refractive index, and a second lens 95*b* having a second refractive index different from the first refractive index. The first refractive index may, for example, be smaller than the second refractive index. The first lens 95*a* may include a first surface 95*a*1 that is flat and a second surface 95*a*2 that is concave, and the second lens 95*b* may include a third surface 95*b*1 that is convex corresponding to the second surface 95*a*2 and a fourth surface 95*b*2 that is flat. The flat first surface 95*a*1 allows simper coupling to the distributed Bragg reflector 60. The first and second lenses 95*a* and 95*b* are assembled together in a manner that the second and third surfaces 95*a*2 and 95*b*1, which matches the shape of each other, are facing each other. The first and second lenses 95*a* and 95*b* may be formed, for example, in one body via ultraviolet ray molding by sequentially stacking polymers having different refractive indexes in a lens form. The micro diffractive device array 90 may be formed, for example, by molding the fourth surface 95*b*2 of the second lens 95*b*.

In one embodiment, the distributed Bragg reflector 60 may be directly adhered to a light emitting surface of the light source array 52 without any interposing layer, and since the surface of the light focusing unit 80 that is being coupled to the distributed Bragg reflector 60 is flat, it is convenient to combine the distributed Bragg reflector 60 and the light focusing unit 80. The divergence angle of a beam is reduced by the distributed Bragg reflector 60, and thus a crosstalk between neighboring pixels may be reduced. Moreover, chromatic aberration may occur due to the wide wavelength width of the spectrum of the emitted beam when a light emitting device, such as an OLED or an inorganic EL, is used as the light source. With the above described configuration of print head, however, the chromatic aberration can be reduced by reducing the wavelength width of the emitted beam by using the distributed Bragg reflector 60. In addition, a higher accuracy of the image may be obtained by increasing the depth of focus, which may be achieved by the use of the refractive-diffractive hybrid lens array as the light focusing unit 80.

Figure 5:
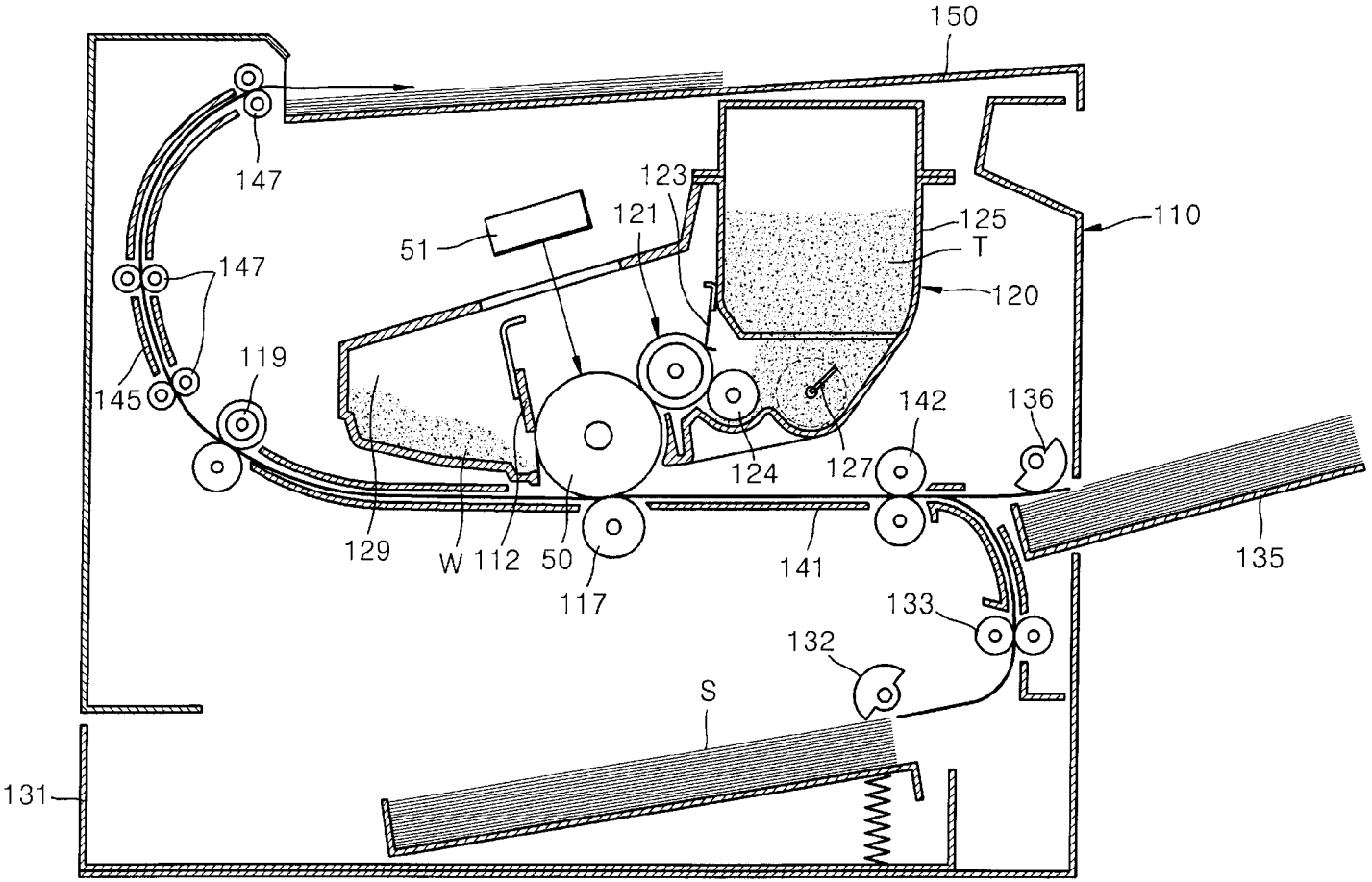
FIG. 5 illustrates an image forming apparatus according to an embodiment.

FIG. 5 is a diagram illustrating an image forming apparatus according to an embodiment. Referring to FIG. 5, the image forming apparatus includes a photosensitive medium 50, a print head 51 forming a latent image on the photosensitive medium 50, a developing unit 120 forming an image corresponding to the latent image by supplying developer T to the photosensitive medium 50, a transfer unit 117 transferring the image formed on the photosensitive medium 50 to a printing medium S, and a fusing unit 119 fusing the image transferred to the printing medium S.

The print head 51 forms a latent image corresponding to an image to be printed according to each pixel of the photosensitive medium 50. The print head 51 includes a plurality of light emitting points corresponding to the number of the pixels, and the light emitting points corresponding to each pixel are turned on or off according to image information received from a controller (not shown). The print head 51 may be those various embodiments described above and shown in FIGS. 2 through 4, and thus details thereof are omitted.

The photosensitive medium 50, the print head 51, the developing unit 120, the transfer unit 117 and the fusing unit 119 may be housed inside a cabinet 110. The developing unit 120 contains the developer T in a container 125, and supplies the developer T to the photosensitive medium 50 via a mixer 127, a supplying roller 124 and a developing roller 121, thus forming a visible developer image on the latent image of the photosensitive medium 50. A regulation blade 123, which regulates the amount of the supplied developer T, may be provided on the circumference of the developing roller 121. According to such a developing unit 120, the developer T transferred via the developing roller 121 passes between the regulation blade 123 and the developing roller 121, thereby forming a developer layer having a predetermined thickness. A waste developer container 129, which contains a waste developer W collected by a cleaning blade 112, may be provided inside the developing unit 120.

As described above, the image formed on the photosensitive medium 50 by the developing unit 120 is transferred to the printing medium S fed between the photosensitive medium 50 and the transfer unit 117, and fuses on the printing medium S by the fusing unit 119.

The image forming apparatus according to an embodiment prints an image on the printing medium S supplied through a first and second paper supply cassettes 131 and 135, and may include a paper feeding path 141 and a paper discharge path 145 of the printing medium S. The paper feeding path 141 may include pickup rollers 132 and 136 for picking up printing media S one by one, a feeding roller 133 for guiding the picked up printing medium S and a registration roller 142 for controlling the alignment of the printing medium S so that the image may be formed on the desired locations thereof. The fusing unit 119 and a plurality of paper discharge rollers 147 may be provided on the paper discharge path 145. The image formed in the photosensitive medium 50 is transferred by the transfer unit 117, and is fused by the fusing unit 119, on the printing medium S supplied along the paper feeding path 141 from the first and/or second paper supply cassettes 131 and 135. Then, the printed printing medium S is stacked on a stacker 150 provided above the cabinet 110, via the paper discharge path 145, thus completing the printing process.

According to one or more of the above described embodiments, it is possible to provide substantially planar surfaces of light source array and the light focusing unit, and to thus simplify fabrication of a print head. In another aspect, by reducing the divergence angle of light emitted from the light source array with the use of the distributed Bragg reflector, optical crosstalk and/or chromatic aberration can be reduced. The depth of focus may be increased by the light focusing unit according to one or more embodiments disclosed.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A print head for irradiating light onto a plurality of locations of a photosensitive medium, comprising:

a light source array including light emitting points corresponding to each of the plurality of locations of the photosensitive medium;

a distributed Bragg reflector disposed adjacent a light emitting surface of the light source array; and a light focusing unit which focuses light that have passed through the distributed Bragg reflector onto the photosensitive medium, wherein the light focusing unit comprises a micro lens array disposed on one side of the distributed Bragg reflector, each micro lens of the micro lens array being arranged to correspond to a respective one of the plurality of locations of the photosensitive medium, wherein the micro lens array comprises an array of refractive lenses, the light focusing unit further comprising a micro diffractive device array formed on one side of the micro lens array in a manner such that each micro diffractive device corresponds to a respective one of the refractive lens, wherein a first side of the micro lens array adjacent the distributed Bragg reflector and a second side opposite the first side each form a substantially planar surface, wherein the second side comprises interfacing surfaces of each of the micro lenses in the micro lens array, and wherein the interfacing surfaces are adjacent to the micro diffractive device array to couple the micro lens array to the micro diffractive device.

2. The print head of claim 1, wherein each micro lens of the micro lens array comprises a gradient index lens.

3. The print head of claim 1, wherein each micro lens of the micro lens array comprises:

a first lens having a first refractive index, the first lens comprising a first surface that is flat and a second surface that is concave; and a second lens having a second refractive index different from the first refractive index, the second lens comprising a third surface that is convex corresponding to concavity of the second surface and a fourth surface that is flat.

4. The print head of claim 3, wherein the first refractive index is smaller than the second refractive index.

5. The print head of claim 1, wherein the distributed Bragg reflector comprises an odd number of layers, the odd number being greater than or equal to three, each neighboring pair of layers being of materials of different refractive indexes with respect to each other.

6. The print head of claim 1, wherein each of the light emitting points is any one selected from the group consisting of an organic light emitting diode, an organic electroluminescence and an inorganic electroluminescence.

7. An image forming apparatus, comprising:

a photosensitive medium configured to carry thereon a latent image;

a print head which irradiates light to locations on the photosensitive medium corresponding to pixels of the latent image, the print head comprising a light source array including light emitting points corresponding to each of the pixels, a distributed Bragg reflector disposed on a light emitting surface of the light source array and a light focusing unit configured to focus light from the light emitting points that have passed through the distributed Bragg reflector onto the photosensitive medium;

a developing unit configured to supply developer to the photosensitive medium to form a visible image corresponding to the latent image;

a transfer unit which transfers the visible image onto a printing medium; and a fusing unit configured to fix the transferred visible image on the printing medium, wherein the light focusing unit comprises a micro lens array disposed on one side of the distributed Bragg reflector, each micro lens of the micro lens array being arranged to correspond to a respective one of the pixels, wherein the micro lens array comprises an array of refractive lenses, the light focusing unit further comprising a micro diffractive device array formed on one side of the micro lens array in a manner such that each micro diffractive device corresponds to a respective one of the refractive lens, wherein a first side of the micro lens adjacent the distributed Bragg reflector and a second side opposite the first side each form a substantially planar surface, wherein the second side comprises interfacing surfaces of each of the micro lenses in the micro lens array, and wherein the interfacing surfaces are adjacent to the micro diffractive device array to couple the micro lens array to the micro diffractive device.

8. The image forming apparatus of claim 7, wherein each micro lens of the micro lens array comprises a gradient index lens.

9. The image forming apparatus of claim 7, wherein each micro lens of the micro lens array comprises: a first lens having a first refractive index, the first lens comprising a first surface that is flat and a second surface that is concave; and a second lens having a second refractive index different from the first refractive index, the second lens comprising a third surface that is convex corresponding to concavity of the second surface and a fourth surface that is flat.

10. The image forming apparatus of claim 9, wherein the first refractive index is smaller than the second refractive index.

11. The image forming apparatus of claim 7, wherein the distributed Bragg reflector comprises an odd number of layers, the odd number being greater than or equal to three, each neighboring pair of layers being of materials of different refractive indexes with respect to each other.

12. The image forming apparatus of claim 7, wherein each of the light emitting points is any one selected from the group consisting of an organic light emitting diode, an organic electroluminescence and an inorganic electroluminescence.

13. A print head for forming an electrostatic latent image on a photosensitive medium, comprising:

a light source array including a plurality of light emitting sources, each of which corresponding to a respective one of pixels of the electrostatic latent image, and a light emitting surface from which light beams from the light emitting sources are output from the light source array;

a reflector disposed adjacent the light emitting surface of the light source array to receive the light beams therefrom, the reflector having a periodically varying index of refraction to output a portion of the light beams received from the light source array as reflected output beams; and a light focusing unit disposed adjacent the reflector, the light focusing unit comprising an array of lenses configured to focus the reflected output beams received from the reflector onto locations on the photosensitive medium corresponding to the pixels, wherein each of respective outer surfaces of the light source array, the reflector and the light focusing unit at each of a first interface between the light source array and the reflector and a second interface between the reflector and the light focusing unit is substantially planar, and wherein the array of lenses in the light focusing unit comprises an array of refractive lens, the light focusing unit further comprising a micro diffractive array formed on one side of the array of refractive lenses in a manner such that each micro diffractive device of the micro diffractive device array is adjacent to a respective one of the refractive lenses in the refractive lens array.

* * * * *